US006763208B2

(12) United States Patent
Nagatsuna et al.

(10) Patent No.: US 6,763,208 B2
(45) Date of Patent: Jul. 13, 2004

(54) PHOTORECEPTOR REGENERATING APPARATUS AND IMAGE FORMING APPARATUS USING REGENERATED PHOTORECEPTOR AND METHOD OF REGENERATING PHOTORECEPTOR

(75) Inventors: Shinji Nagatsuna, Ohta-ku (JP); Takeshi Saitou, Hachiohji (JP); Takeo Suda, Katsushika-ku (JP); Kenichi Shishido, Ebina (JP); Masaki Narita, Suginami-ku (JP)

(73) Assignee: Ricoh Company, Ltd., Tokyo (JP)

( * ) Notice: Subject to any disclaimer, the term of this patent is extended or adjusted under 35 U.S.C. 154(b) by 18 days.

(21) Appl. No.: 10/102,875

(22) Filed: Mar. 22, 2002

(65) Prior Publication Data

US 2002/0136565 A1 Sep. 26, 2002

(30) Foreign Application Priority Data

Mar. 22, 2001 (JP) ..... 2001-083756
Feb. 21, 2002 (JP) ..... 2002-045321

(51) Int. Cl.[7] ..... G03G 15/00
(52) U.S. Cl. ..... 399/109; 399/26
(58) Field of Search ..... 399/12, 24–26, 399/109, 111, 159; 29/895.1; 156/94

(56) References Cited

U.S. PATENT DOCUMENTS

| | | | | |
|---|---|---|---|---|
| 5,028,502 A | | 7/1991 | Yuh et al. | 430/31 |
| 5,100,453 A | | 3/1992 | Richards | 65/27 |
| 5,315,325 A | * | 5/1994 | Strouth | 347/140 |
| 5,789,128 A | | 8/1998 | Adachi et al. | 430/83 |
| 5,834,145 A | | 11/1998 | Yoshinaga et al. | 430/31 |
| 5,846,680 A | | 12/1998 | Adachi et al. | 430/73 |
| 5,910,561 A | | 6/1999 | Adachi et al. | 528/196 |
| 5,928,828 A | | 7/1999 | Suziki | 430/126 |
| 5,942,363 A | | 8/1999 | Tanaka et al. | 430/75 |
| 5,999,773 A | | 12/1999 | Yasutomi et al. | 399/148 |
| 6,026,262 A | | 2/2000 | Kinoshita et al. | 399/252 |
| 6,030,736 A | | 2/2000 | Ikegami et al. | 430/59.6 |
| 6,069,224 A | | 5/2000 | Adachi et al. | 528/198 |
| 6,136,483 A | | 10/2000 | Suzukii et al. | 430/58.7 |
| 6,191,249 B1 | | 2/2001 | Tanaka et al. | 528/196 |
| 6,249,304 B1 | | 6/2001 | Sawayama et al. | 347/228 |
| 6,322,940 B1 | | 11/2001 | Nishigaki et al. | 430/58.05 |
| 6,326,112 B1 | | 12/2001 | Tamura et al. | 430/58.7 |
| 6,366,751 B1 | | 4/2002 | Shakuto et al. | 399/159 |
| 6,432,596 B2 | | 8/2002 | Ikuno et al. | 430/58.05 |
| 6,444,387 B2 | | 9/2002 | Ri et al. | 430/67 |
| 6,492,079 B2 | | 12/2002 | Shimada et al. | 430/58.05 |

FOREIGN PATENT DOCUMENTS

| | | |
|---|---|---|
| DE | 39 13 613 | 11/1989 |
| JP | 57-139746 | 8/1982 |
| JP | 59-222868 | 12/1984 |
| JP | 1-126669 | 5/1989 |
| JP | 02-034862 | 2/1990 |
| JP | 2-287480 | * 11/1990 |
| JP | 6-186763 | 7/1994 |
| JP | 7-199727 | 8/1995 |
| JP | 8-076639 | 3/1996 |
| JP | 8-123429 | 5/1996 |
| JP | 8-234624 | 9/1996 |
| JP | 8-254838 | 10/1996 |
| JP | 9-062016 | 3/1997 |
| JP | 11-7219 | * 1/1999 |

* cited by examiner

*Primary Examiner*—Hoan Tran
(74) *Attorney, Agent, or Firm*—Oblon, Spivak, McClelland, Maier & Neustadt, P.C.

(57) ABSTRACT

A photoreceptor regenerating apparatus for regenerating a photoreceptor for use in an image forming apparatus including a grinding member that grinds a surface of a used photoreceptor, a photoreceptor measuring device that measures a surface condition of the used photoreceptor, and a grinding condition setting device that sets grinding conditions of the grinding member according to a measurement value of the photoreceptor measuring device.

19 Claims, 11 Drawing Sheets

FIG. 12

| SURFACE ROUGHNESS (Rmax) | REVOLUTION SPEED OF PHOTO-RECEPTOR (rpm) | REVOLUTION SPEED OF GRINDING MEMBER (rpm) | MOVING SPEED OF GRINDING MEMBER (mm/sec) | NUMBER OF TIMES OF RECIPRO-CATING MOTIONS OF GRINDING MEMBER | PRESSING FORCE OF GRINDING MEMBER (gf/cm²) |
|---|---|---|---|---|---|
| 4.7~7.5 | 80 | 600 | 30 | 1 | 100 |
| 7.5~8.5 | 120 | 900 | 15 | 2 | 200 |
| 8.5~11 | 160 | 1200 | 10 | 3 | 300 |

FIG. 14

| LAYER THICKNESS (μm) | REVOLUTION SPEED OF PHOTO-RECEPTOR (rpm) | REVOLUTION SPEED OF GRINDING MEMBER (rpm) | MOVING SPEED OF GRINDING MEMBER (mm/sec) | NUMBER OF TIMES OF RECIPRO-CATING MOTIONS OF GRINDING MEMBER | PRESSING FORCE OF GRINDING MEMBER (gf/cm²) |
|---|---|---|---|---|---|
| 22~24 | 80 | 600 | 30 | 1 | 100 |
| 24~26 | 120 | 900 | 15 | 2 | 200 |
| 26~28 | 160 | 1200 | 10 | 3 | 300 |

PHOTORECEPTOR REGENERATING APPARATUS AND IMAGE FORMING APPARATUS USING REGENERATED PHOTORECEPTOR AND METHOD OF REGENERATING PHOTORECEPTOR

CROSS REFERENCE TO RELATED APPLICATIONS

This document claims priority and isrelated to Japanese Patent Application No. 2001-083756 filed in the Japanese Patent Office on Mar. 22, 2001, and Japanese Patent Application No. 2002-045321 filed in the Japanese Patent Office on Feb. 21, 2002, the entire contents of which are incorporated herein by reference.

BACKGROUND OF THE INVENTION

1. Field of the Invention

The present invention relates to a photoreceptor regenerating apparatus for regenerating a photoreceptor for use in an image forming apparatus and to a method of regenerating a photoreceptor.

2. Discussion of the Background

Recently, demands for reuse and recycling of products have increased in view of environmental protection and reduction of waste. In an image forming apparatus such as a copying machine, a printer, a facsimile machine, etc., recycling of a used main body, a used image forming unit, and used parts has increased under law enforcement.

As a number of copying or printing sheets increases, a photosensitive layer of an electrophotographic photoreceptor (hereinafter simply referred to as a photoreceptor) is abraded by a cleaning blade in sliding contact with the photoreceptor and by the developer on a developing roller. If a thickness of a remaining portion of the photosensitive layer becomes less than a predetermined value, charge leakage from a device, such as a charging device, a transfer device, and a developing device to which a bias voltage is applied, to the photoreceptor typically occurs. The leakage to the photoreceptor results in deterioration of image quality. Further, a photosensitive property of the photoreceptor typically deteriorates, so that a good quality image may not be obtained.

In addition, foreign substances, such as for example resin, additives contained in toner for development, and a paper powder of a transfer sheet, typically adhere to the surface of the photoreceptor. Such the foreign substances adhered onto the surface of the photoreceptor deteriorate a property of the photoreceptor such as a photosensitive property and a surface property, thereby resulting in an image failure such as a white line, a black line, a white blank, or an uneven image.

An amount of abrasion of the photosensitive layer, an amount of foreign substances adhered to the surface of the photoreceptor, and a condition of adhesion vary depending on an environmental condition and a mode in which the photoreceptor is used.

With regard to background techniques of regenerating a photoreceptor, a method of regenerating a photoreceptor by abrading foreign substances adhered to the surface of the photoreceptor with an abrasive has been proposed. For example, Japanese Laid-open Patent Publication No. 8-123249 describes a refiner for an electrophotographic photoreceptor, that has good refining property and wiping property and does not cause cracks on the electrophotographic photoreceptor surface by dispersing an abrasive in a water-based emulsion, and a refining method. Japanese Laid-open Patent Publication No. 8-234624 describes a refiner for an electrophotographic photoreceptor in which an abrasive is suspended in water, a water-soluble organic solvent, and a surfactant, and a refining method. Japanese Laid-open Patent Publication No. 8-254838 describes a refiner for an electrophotographic photoreceptor in which an abrasive is dispersed in an oil-based emulsion by using water, organic solvent and surfactant, and a refining method. Japanese Laid-open Patent Publication No. 9-62016 describes an electrophotographic photoreceptor in which the surface of the electrophotographic photoreceptor is abraded by using an abrasive material which carries dispersion of particles having 5 Mohs' hardness or greater.

The above-described background arts are not related to a specific method of grinding a surface of a photoreceptor, but related to materials of abrasives.

SUMMARY OF THE INVENTION

One object of the present invention is to provide a photoreceptor regenerating apparatus and a method of regenerating a photoreceptor that allow a used photoreceptor to be ground and regenerated adequately according to a surface condition of the used photoreceptor.

According to one aspect of the present invention, a photoreceptor regenerating apparatus for regenerating a photoreceptor for use in an image forming apparatus includes a grinding member configured to grind a surface of a used photoreceptor, a photoreceptor measuring device configured to measure a surface condition of the used photoreceptor, and a grinding condition setting device configured to set grinding conditions of the grinding member according to a measurement value of the photoreceptor measuring device.

According to another aspect of the present invention, a method of regenerating a photoreceptor for use in an image forming apparatus includes the steps of measuring a surface condition of a used photoreceptor by a photoreceptor measuring device, setting grinding conditions of a grinding member according to a measurement value of the photoreceptor measuring device, and grinding a surface of the used photoreceptor by the grinding member.

Other objects, features, and advantages of the present invention will become apparent from the following detailed description when read in conjunction with the accompanying drawings.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein:

FIG. 12 is a table showing grinding conditions of the photoreceptor grinding device set for a respective measured surface roughness of the photoreceptor;

FIG. 14 is a table showing grinding conditions of the photoreceptor grinding device set for a respective measured layer thickness of the photoreceptor.

DESCRIPTION OF THE PREFERRED EMBODIMENTS

Figure 1:
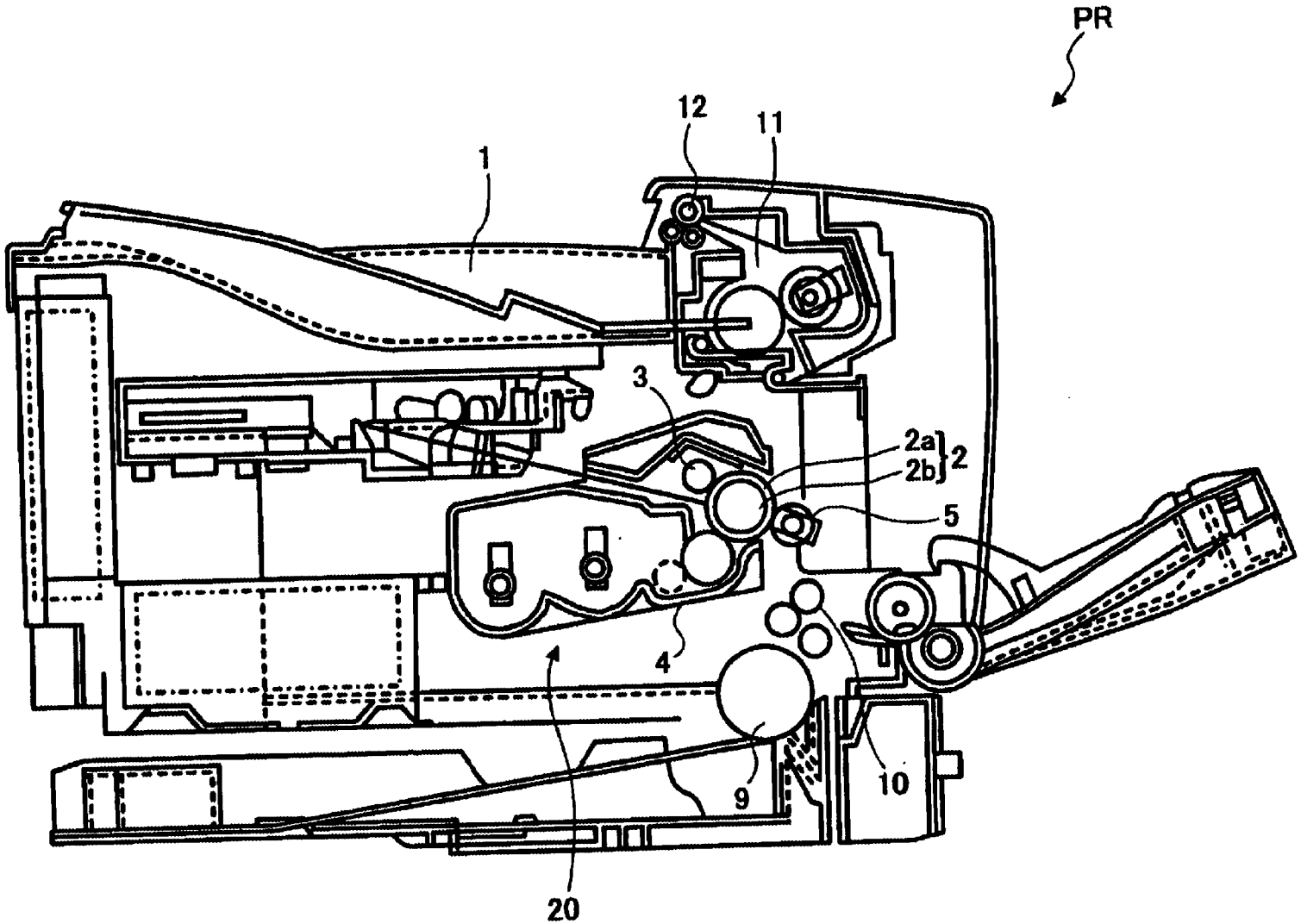
FIG. 1 is a schematic view of an overall structure of a laser printer serving as an image forming apparatus according to an embodiment of the present invention.

Preferred embodiments of the present invention are described in detail referring to the drawings, wherein like reference numerals designate identical or corresponding parts throughout the several views.

FIG. 1 is a schematic view of an overall structure of a laser printer PR serving as an example of an image forming apparatus according to one embodiment of the present invention. In a main body case 1 of the laser printer PR, a drum-shaped photoreceptor 2 is provided at a substantially center part of the laser printer PR. As illustrated in FIG. 1, the photoreceptor 2 includes a photosensitive layer 2*a* and a substrate 2*b* on which the photosensitive layer 2*a* is formed. In this embodiment, for example, the photosensitive layer 2*a* has a thickness of about 30 $\mu$m, and the substrate 2*b* is made of aluminum. Arranged around the photoreceptor 2 are a charging device 3, a developing device 4, a transfer device 5, a cleaning device (not shown), etc. An electrophotographic image forming process cartridge 20 (hereinafter simply referred to as a process cartridge 20) integrally accommodates the photoreceptor 2, the charging device 3, the developing device 4, the transfer device 5, the cleaning device, etc. The process cartridge 20 is replaced with a new one when all toner in the developing device 4 is used.

Provided below the process cartridge 20 are a sheet feeding roller 9 that feeds transfer sheets one by one, and a pair of registration rollers 10 that convey the transfer sheets fed by the sheet feeding roller 9 toward the transfer device 5 at a predetermined timing. Provided above the process cartridge 20 are a fixing device 11 that fixes an image transferred onto the transfer sheet by the transfer device 5 and a sheet discharging roller 12 that discharges the transfer sheet having a fixed image.

Figure 2:
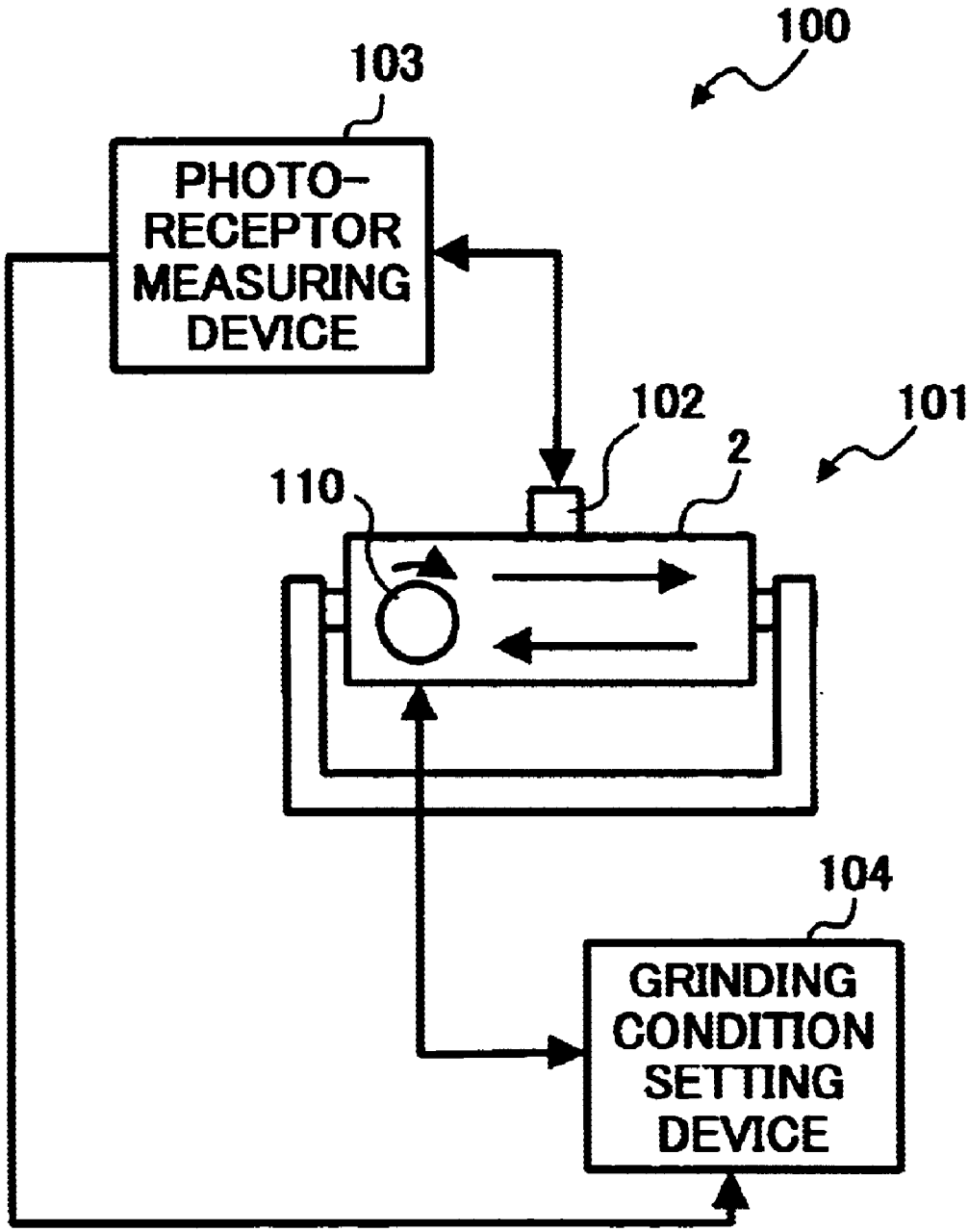
FIG. 2 is a schematic view of a construction of a photoreceptor regenerating apparatus according to an embodiment of the present invention.
Figure 3A:
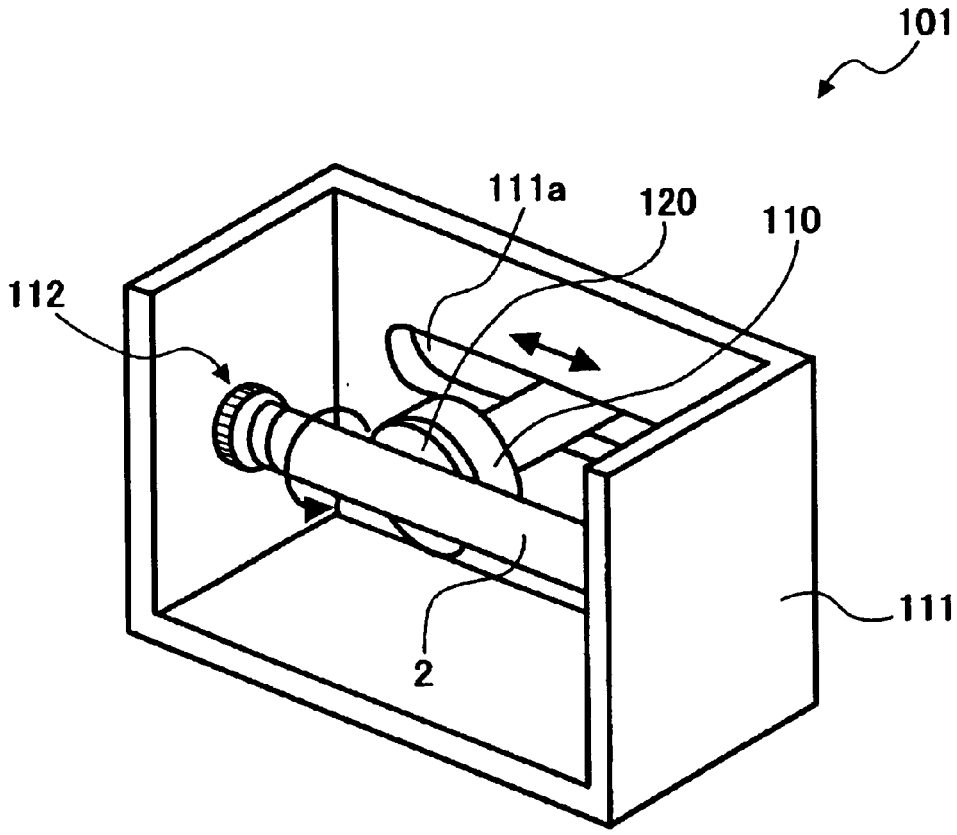
FIG. 3A is a schematic perspective view of a photoreceptor grinding device included in the photoreceptor regenerating apparatus of FIG. 2.
Figure 3B:
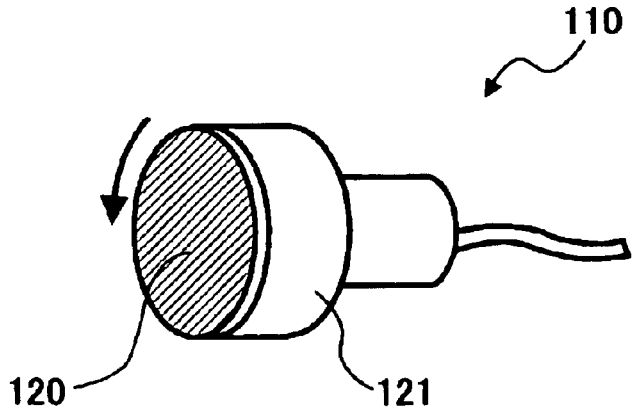
FIG. 3B is a schematic perspective view of a grinding member of the photoreceptor grinding device of FIG. 3A.

FIG. 2 is a schematic view of a construction of a photoreceptor regenerating apparatus that regenerates a photoreceptor for use in an image forming apparatus, according to one embodiment of the present invention. FIG. 3A is a schematic perspective view of a photoreceptor grinding device included in the photoreceptor regenerating apparatus of FIG. 2. FIG. 3B is a schematic perspective view of a grinding member of the photoreceptor grinding device of FIG. 3A.

Referring to FIG. 2, a photoreceptor regenerating apparatus 100 includes a photoreceptor grinding device 101 that grinds the surface of the used photoreceptor 2, a detector 102 that detects a surface condition of the used photoreceptor 2, and a photoreceptor measuring device 103 that measures the surface condition of the used photoreceptor 2 to detect, for example, an amount of abrasion of the photoreceptor 2 or an amount of a foreign substance adhered to the surface of the photoreceptor 2, based on detection data of the detector 102. The photoreceptor regenerating apparatus 100 further includes a grinding condition setting device 104 that sets grinding conditions, such as revolution speed of the photoreceptor 2, a number of revolutions, a moving speed, a number of reciprocating motions, and a pressing force of a grinding member 110 of the photoreceptor grinding device 101, according to a measurement value of the photoreceptor measuring device 103.

Referring to FIG. 3A, the photoreceptor grinding device 101 includes a case 111 and supporting parts (not shown) that support the photoreceptor 2 at both sides of the case 111 so that the photoreceptor 2 is rotatable. A hole 111*a*, e.g. an oblong hole, is provided in the case 111, and the grinding member 110 of the photoreceptor grinding device 101 is configured to be movable in a substantially horizontal direction along the oblong hole 111*a*.

As illustrated in FIG. 3B, the grinding member 110 includes a cylindrical elastic body 121 formed from, for example, an urethane foaming material, and a grinding pad 120. The grinding pad 120 is formed from a nonwoven fabric material and is attached onto one side of the elastic body 121.

A used photoreceptor 2 collected from users is rotatably held by the supporting parts of the case 111 of the photoreceptor grinding device 101. The supporting parts are driven by a motor (not shown in FIG. 3A) via a gear (not shown in FIG. 3A) engaged with a flange gear 112 provided at one of the supporting parts, thereby causing the photoreceptor 2 to rotate.

When grinding the photoreceptor 2, the photoreceptor 2 is set in the photoreceptor grinding device 101, and is then ground by the grinding pad 120 abutted against the surface of the photosensitive layer 2*a* of the photoreceptor 2 with a predetermined pressing force. The grinding pad 120 moves at a predetermined speed in the axial direction of the photoreceptor 2 while rotating at a predetermined revolution speed, thereby grinding at least a width of a part of the photoreceptor 2 corresponding to an image forming area thereof. The grinding pad 120 may perform plural reciprocating motions in the axial direction of the photoreceptor 2.

Further, when grinding the photoreceptor 2, an abrasive such as for example aluminum oxide dispersed in water is applied between the photoreceptor 2 and the grinding pad 120 of the grinding member 110. The grinding pad 120 removes foreign substances, such as for example resin and additives contained in the toner and carrier for development, and a paper powder of a transfer sheet, adhered to the used photoreceptor 2.

Figure 4:
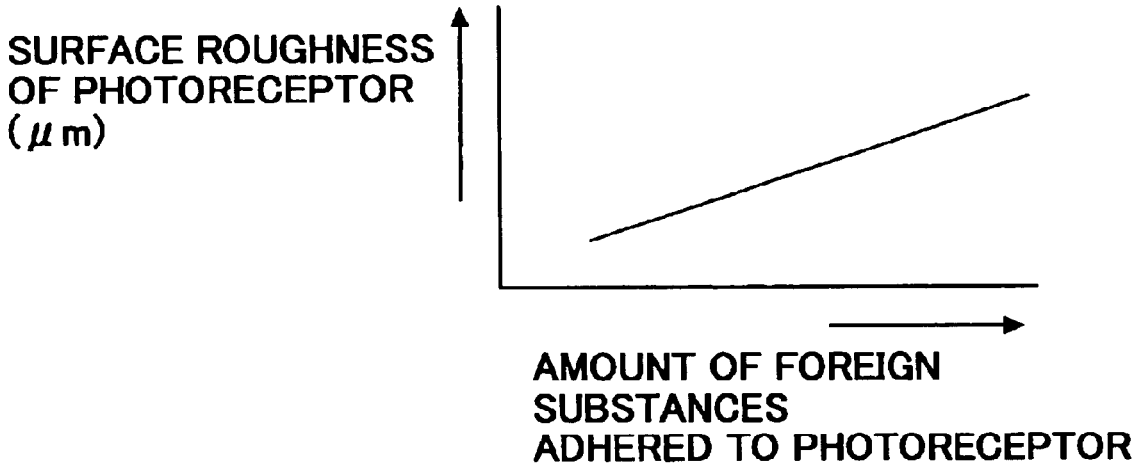
FIG. 4 is a graph illustrating a relationship between an amount of foreign substances adhered to a photoreceptor and a surface roughness of the photoreceptor.

As a number of printing sheets increases, foreign substances adhere to the surface of the photoreceptor 2. Because the foreign substances adhere to the surface of the photoreceptor 2 in a streak shape along a rotational direction of the photoreceptor 2, a surface roughness of the photoreceptor 2 in an axial direction thereof increases. Further, as an amount of foreign substances adhered to the surface of the photoreceptor 2 increases, the surface roughness of the photoreceptor 2 increases. FIG. 4 is a graph illustrating a relationship between the amount of foreign substances adhered to the surface of the photoreceptor 2 and the surface roughness of the photoreceptor 2. The foreign substances cause the property of the photoreceptor 2 to deteriorate, thereby resulting in an occurrence of an image failure such as a white line, a black line, a white blank, and an uneven image.

Further, as image forming operations are repeated, the photosensitive layer 2*a* is abraded by a contact member such as a cleaning blade (not shown) in sliding contact with the photoreceptor 2. If a thickness of a remaining portion of the photosensitive layer 2*a* becomes a predetermined thickness or less, charge leakage from a device, such as the charging device 3, the developing device 4, and the transfer device 5 to which a bias voltage is applied, to the photoreceptor 2 typically occurs. The leakage to the photoreceptor 2 results in deterioration of image quality. Further, a photosensitive property of the photoreceptor 2 typically deteriorates so that a good quality image may not be obtained.

Figure 5:
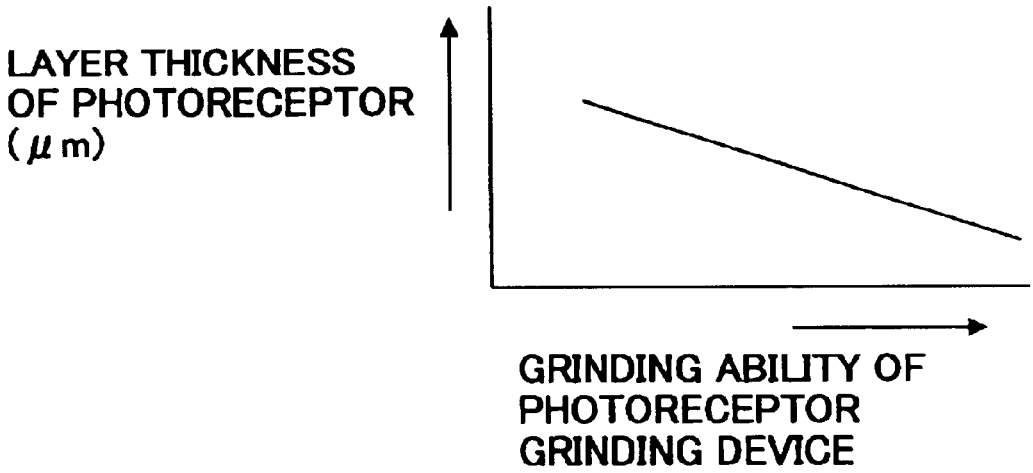
FIG. 5 is a graph illustrating a relationship between a grinding ability of the photoreceptor grinding device and a thickness of a photosensitive layer of the photoreceptor.

As a grinding ability of the photoreceptor grinding device 101 increases, the thickness of the photosensitive layer 2*a* of the photoreceptor 2 decreases. FIG. 5 is a graph illustrating a relationship between the grinding ability of the photoreceptor grinding device 101 and the thickness of the photosensitive layer 2*a* of the photoreceptor 2.

In order to regenerate a collected used photoreceptor or a collected process cartridge accommodating a used photoreceptor, foreign substances adhered to a surface of the used photoreceptor need to be removed therefrom by grinding a surface layer of the used photoreceptor. However, in this case, a thickness of a remaining portion of the surface layer of the photoreceptor needs to be a predetermined thickness in which a photosensitive property of the photoreceptor does not deteriorate.

Therefore, in this embodiment, the photoreceptor measuring device 103 measures the thickness of the photosensitive layer 2*a* of the used photoreceptor 2, and the grinding condition setting device 104 sets an amount of a portion of the photosensitive layer 2*a* ground by the photoreceptor grinding device 101 based on the measurement value of the photoreceptor measuring device 103 and sets grinding conditions of the photoreceptor grinding device 101.

FIGS. 6 through 10 are graphs illustrating a relationship between an amount of a portion of the photosensitive layer 2*a* of the photoreceptor 2 ground by the grinding member 110 of the photoreceptor grinding device 101 (hereinafter may be simply referred to as an "amount of the photoreceptor 2 ground by the grinding member 110") and grinding conditions of the photoreceptor grinding device 101.

Figure 6:
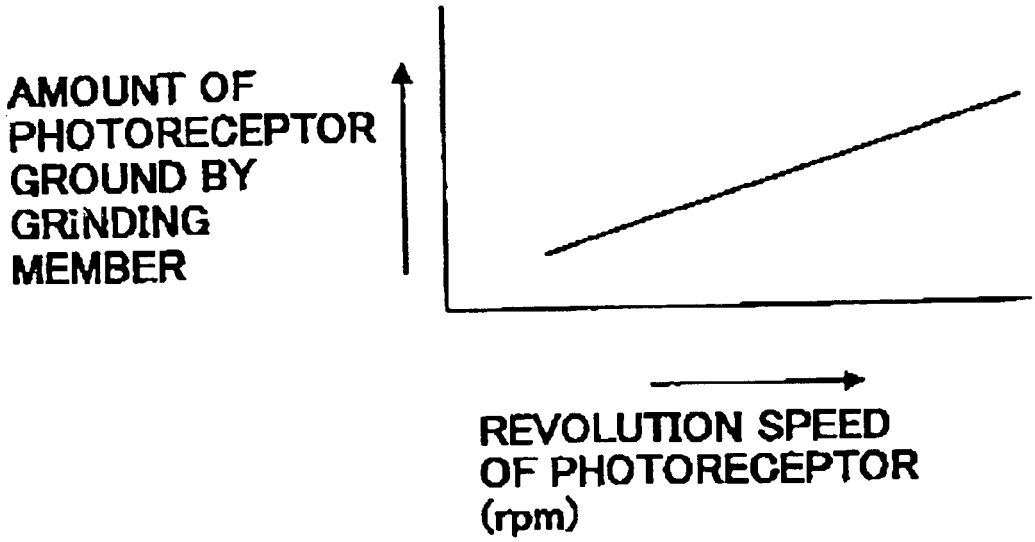
FIG. 6 is a graph illustrating a relationship between an amount of the photoreceptor ground by the grinding member and a revolution speed of the photoreceptor.
Figure 7:
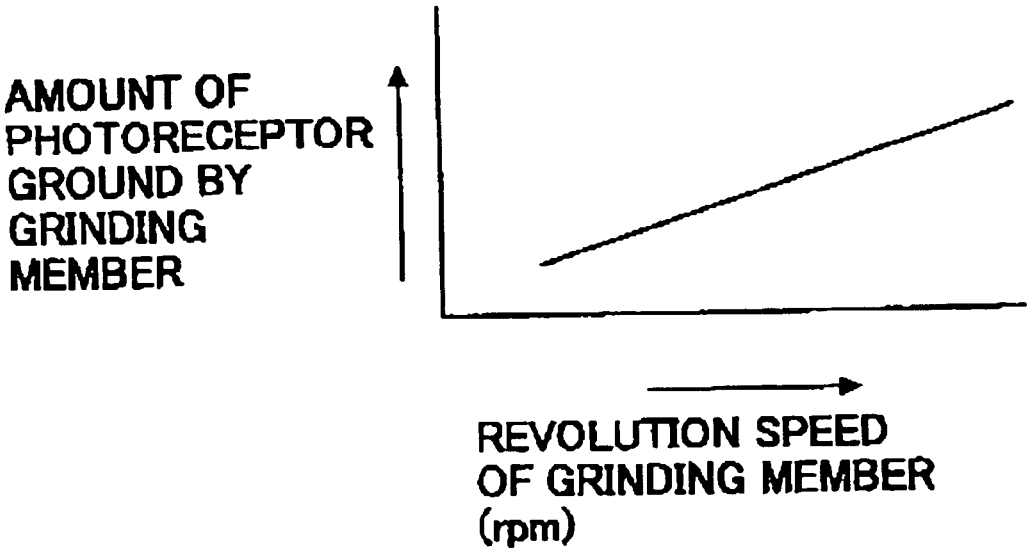
FIG. 7 is a graph illustrating a relationship between an amount of the photoreceptor ground by the grinding member and a revolution speed of the grinding member.
Figure 8:
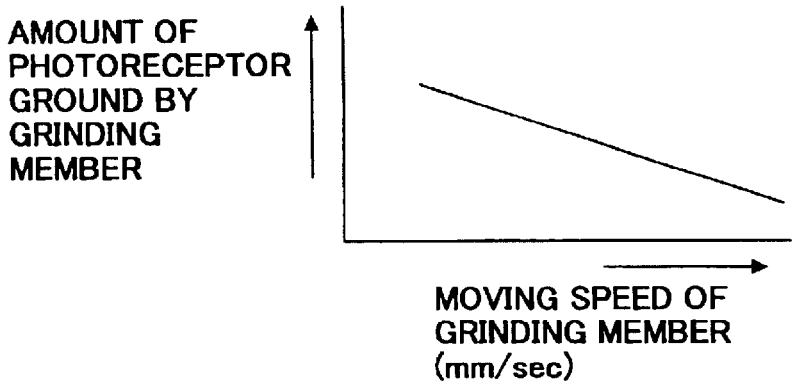
FIG. 8 is a graph illustrating a relationship between an amount of the photoreceptor ground by the grinding member and a moving speed of the grinding member.

Specifically, the graph of FIG. 6 shows that the amount of the photoreceptor 2 ground by the grinding member 110 increases as a revolution speed (rpm) of the photoreceptor 2 increases. Referring to FIG. 7, the graph shows that the amount of the photoreceptor 2 ground by the grinding member 110 increases as a revolution speed (rpm) of the grinding member 110 increases. Referring further to FIG. 8, the graph shows that the amount of the photoreceptor 2 ground by the grinding member 110 decreases as a moving speed of the grinding member 110 increases.

Figure 9:
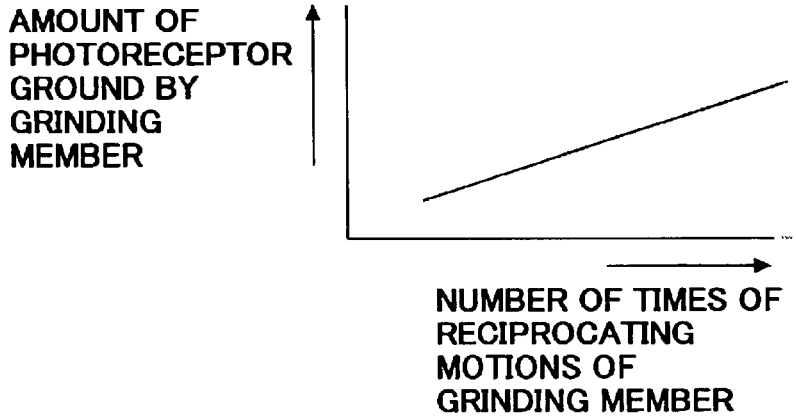
FIG. 9 is a graph illustrating a relationship between an amount of the photoreceptor ground by the grinding member and a number of reciprocating motions of the grinding member.
Figure 10:
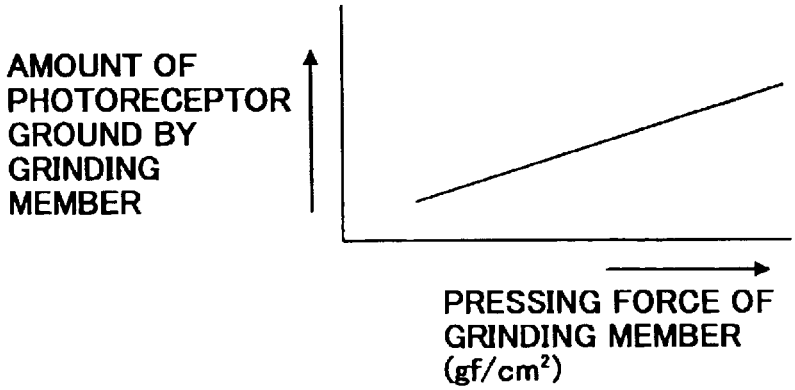
FIG. 10 is a graph illustrating a relationship between an amount of the photoreceptor ground by the grinding member and a pressing force of the grinding member.

Moreover, the graph of FIG. 9 shows that the amount of the photoreceptor 2 ground by the grinding member 110 increases as a number of times of reciprocating motions of the grinding member 110 increases. Referring further to FIG. 10, the graph shows that the amount of the photoreceptor 2 ground by the grinding member 110 increases as a pressing force of the grinding member 110 against the photoreceptor 2 increases.

For example, the above-described grinding conditions of the photoreceptor grinding device 101 are set as follows in this embodiment:

- a revolution speed of the used photoreceptor 2: 80 rpm;
- a revolution speed of the grinding member 110: 600 rpm;
- a moving speed of the grinding member 110: 10 mm/sec;
- a number of reciprocating motions of the grinding member 110: three times
- a pressing force of the grinding member 110 against the photoreceptor 2: 100 gf/cm2.

When the surface of the photosensitive layer 2*a* of the photoreceptor 2 is ground under the above-described grinding conditions, foreign substances adhered to the used photoreceptor 2 can be removed from the photoreceptor 2. As a result, the photoreceptor 2 exhibits performance substantially similar to a new (i.e., original) photoreceptor, and thereby a good quality image is obtained.

Next, a construction of a system of the photoreceptor measuring device 103 that measures a surface condition of the used photoreceptor 2 will be described referring to FIGS. 11 and 12.

First, an example of measuring a surface roughness of the photoreceptor 2 by the photoreceptor measuring device 103 will be described referring to FIG. 11. The system of the photoreceptor measuring device 103 of FIG. 11 includes a personal computer 150 that processes measurement data and controls a rotational operation of the photoreceptor 2. The system of the photoreceptor measuring device 103 of FIG. 11 further includes a laser light emitting and measuring device 161 configured to emit laser light to the surface of the photoreceptor 2 and to measure the surface roughness of the photoreceptor 2 based on a light reflected from the photoreceptor 2, and a driving device 162 configured to drive the photoreceptor 2 to rotate in accordance with an instruction of the personal computer 150.

Figure 11:
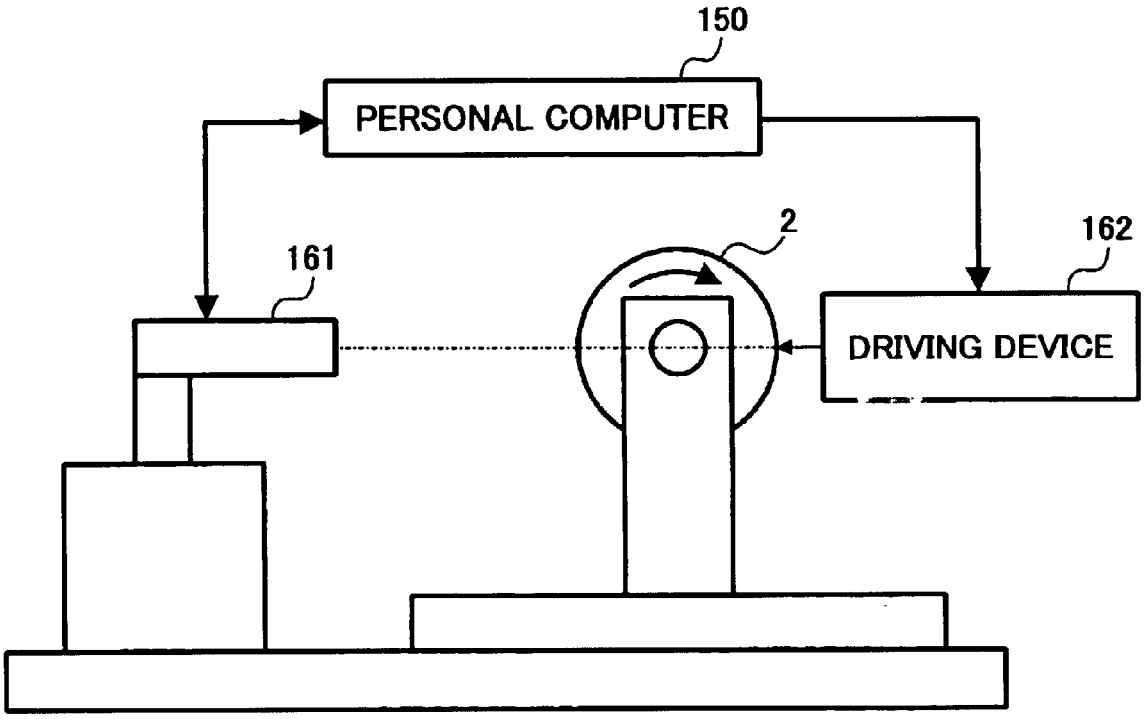
FIG. 11 is a schematic view of a system of a photoreceptor measuring device for measuring a surface roughness of the photoreceptor.

Referring to FIG. 11, the laser light emitting and measuring device 161 is arranged in a non-contacting relation to the surface of the photoreceptor 2. After setting the used photoreceptor 2 into the case of the photoreceptor grinding device 101, the laser light emitting and measuring device 161 emits laser light to the surface of the photoreceptor 2 and measures the surface roughness of the photoreceptor 2 based on the light reflected from the photoreceptor 2. The laser light emitting and measuring device 161 measures the surface roughness of the photoreceptor 2 at several points of the photoreceptor 2, for example, at four points in a circumferencial direction of the photoreceptor 2, and at five points in a longitudinal direction of the photoreceptor 2. The data of the surface roughness of the photoreceptor 2 measured at several points of the photoreceptor 2 is input to the personal computer 150. The average value is used as a value of a surface roughness of the photoreceptor 2.

When measuring the surface roughness of the photoreceptor 2, the driving device 162 drives the photoreceptor 2 to rotate by 90 degrees in accordance with an instruction of the personal computer 150. The laser light emitting and measuring device 161 is configured to move a distance programmed by the personal computer 150 along the photoreceptor 2. After stopping, the laser light emitting and measuring device 161 measures the surface roughness of the photoreceptor 2.

The measured surface roughness of the photoreceptor 2 and the grinding conditions of the photoreceptor grinding device 101 set for the respective measured surface roughness by the grinding condition setting device 104 are shown in the table of FIG. 12. The grinding conditions include a revolution speed of the photoreceptor 2 (rpm), a revolution speed of the grinding member 110 (rpm), a moving speed of the grinding member 110 (mm/sec), a number of reciprocating motions of the grinding member 110, and a pressing force of the grinding member 110 (gf/cm$^2$). When the surface roughness of the photoreceptor 2 is not greater than 4.5 (Rmax), the photoreceptor 2 does not have foreign substances on the surface thereof.

Next, an example of measuring a layer thickness of the photoreceptor 2 by the photoreceptor measuring device 103 will be described referring to FIG. 13. The system of the photoreceptor measuring device 103 of FIG. 13 includes an eddy current measuring device 171 configured to measure a layer thickness of the photoreceptor 2, and an adaptor 172 having a function of a sensor set on the surface of the photoreceptor 2. The system of the photoreceptor measuring device 103 of FIG. 13 further includes the personal computer 150 and the driving device 162 described in FIG. 11.

As described above, the photoreceptor 2 includes the photosensitive layer 2*a* having a thickness of about 30 $\mu$m on the substrate 2*b*. The eddy current measuring device 171 measures a layer thickness of the used photoreceptor 2.

Figure 13:
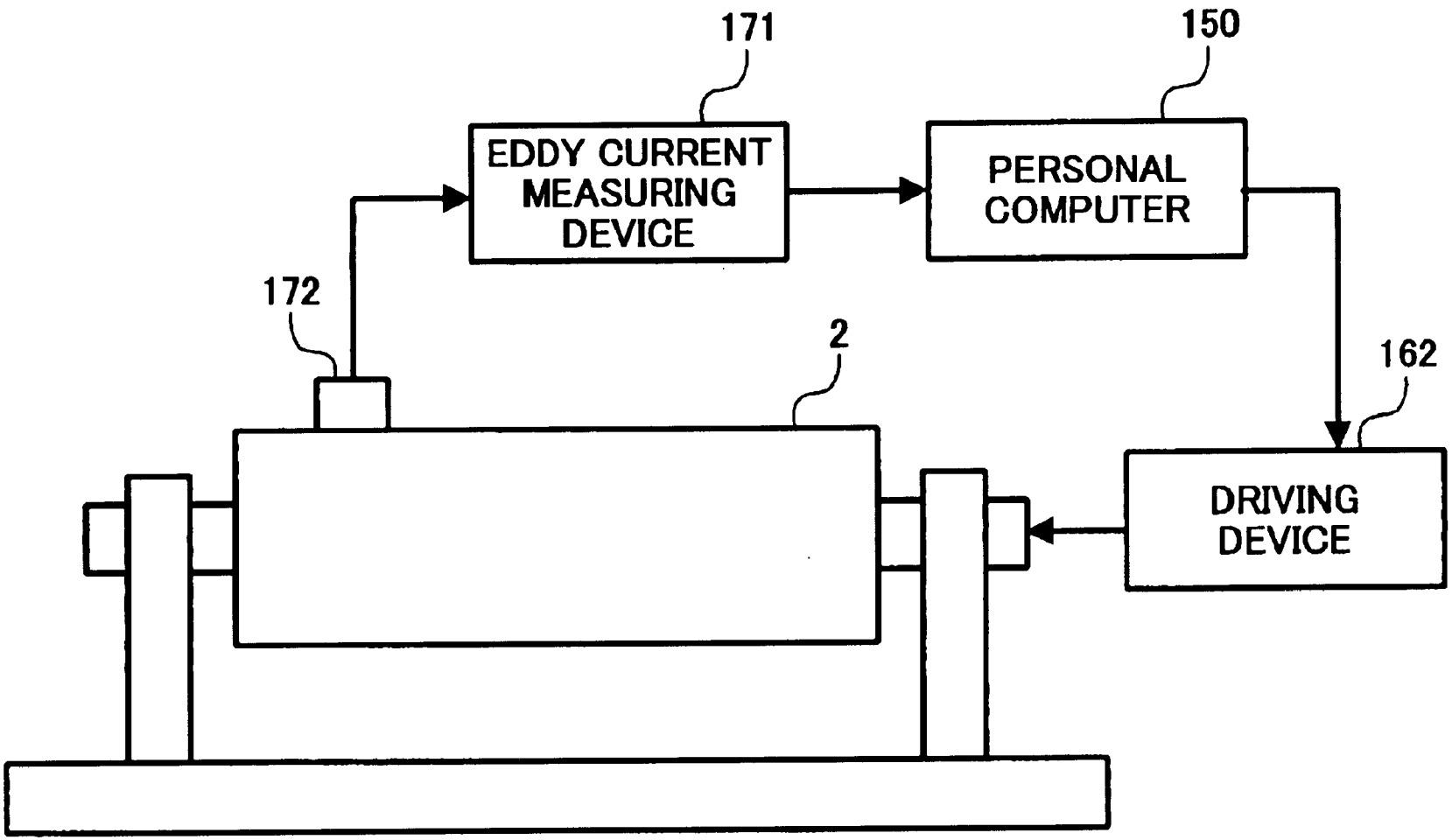
FIG. 13 is a schematic view of a system of the photoreceptor measuring device for measuring a layer thickness of the photoreceptor.

Referring to FIG. 13, the adaptor 172 is arranged in a contacting relation to the surface of the photoreceptor 2. Similarly as in the above-described case of measuring the surface roughness of the photoreceptor 2, after setting the used photoreceptor 2 into the case of the photoreceptor grinding device 101, the adaptor 172 measures the layer thickness of the photoreceptor 2 at four points in a circumferential direction of the photoreceptor 2, and at five points in a longitudinal direction of the photoreceptor 2. The data of the layer thickness of the photoreceptor 2 measured at the above-described points of the photoreceptor 2 is input to the personal computer 150. The average value is used as a value of the layer thickness of the photoreceptor 2.

When measuring the layer thickness of the photoreceptor 2, the driving device 162 drives the photoreceptor 2 to rotate by 90 degrees in accordance with an instruction of the personal computer 150. The adaptor 172 is configured to move a distance programmed by the personal computer 150 along the photoreceptor 2. After stopping, the adaptor 172 measures the layer thickness of the photoreceptor 2.

The measured layer thickness of the photoreceptor 2 and the grinding conditions of the photoreceptor grinding device 101 set for the respective measured layer thickness by the grinding condition setting device 104 are illustrated in a table of FIG. 14. The grinding conditions include a revolution speed of the photoreceptor 2 (rpm), a revolution speed of the grinding member 110 (rpm), a moving speed of the grinding member 110 (mm/sec), a number of reciprocating motions of the grinding member 110, and a pressing force of the grinding member 110 (gf/cm$^2$).

In a strict sense, respective optimum grinding conditions for the measured surface roughness and layer thickness are different from each other. However, in order to simplify the conditions set on the devices, the grinding conditions of the photoreceptor grinding device 101 are shown in round figures in FIGS. 12 and 14. Further, with regard to the pressing force of the grinding member 110, the property of the grinding member 110 such as material and hardness needs to be considered.

Figure 15:
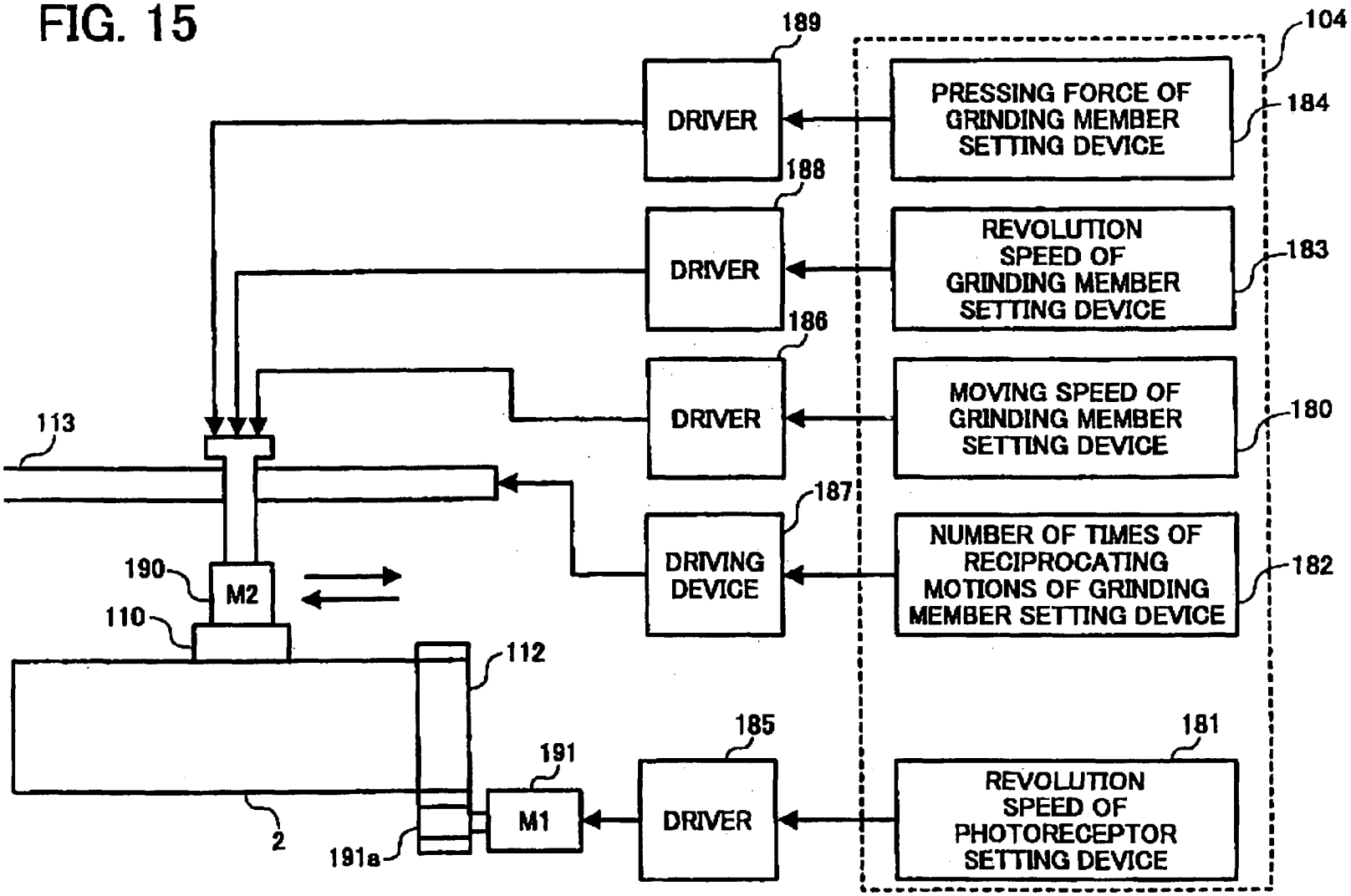
FIG. 15 is a block diagram illustrating a construction of a system in connection with a grinding condition setting device.

Next, a construction of a system in connection with the grinding condition setting device 104 that sets the grinding conditions of the photoreceptor grinding device 101 will be described referring to FIG. 15.

The grinding condition setting device 104 includes a moving speed of grinding member setting device 180, a revolution speed of photoreceptor setting device 181, a number of reciprocating motions of grinding member setting device 182, a revolution speed of grinding member setting device 183, and a pressing force of grinding member setting device 184. The grinding condition setting device 104 includes a personal computer or a control device, and is configured to set the above-described grinding conditions of the photoreceptor grinding device 101 according to parameters (i.e., values of surface roughness and layer thickness of the photoreceptor 2).

Specifically, the revolution speed of photoreceptor setting device 181 is configured to set the revolution speed of the photoreceptor 2 while the photoreceptor 2 is ground by the grinding member 110. The revolution speed of photoreceptor setting device 181 controls a photoreceptor driving motor 191 to drive via a driver 185. A gear 191*a* is fixed onto a shaft of the photoreceptor driving motor 191. The flange gear 112 provided at one of the supporting parts of the case 111 of the photoreceptor grinding device 101 is engaged with the gear 191*a*, thereby rotating the photoreceptor 2.

The number of reciprocating motions of the grinding member setting device 182 is configured to be set to the number of reciprocating motions of the grinding member 110. The number of reciprocating motions of the grinding member setting device 182 controls a reciprocating/driving mechanism 113 configured to drive a driving device 187. The reciprocating/driving mechanism 113 is configured to drive the grinding member 110 such as to reciprocate the grinding member 110 in the axial direction of the photoreceptor 2 a number of times set by the number of reciprocating motions of the grinding member setting device 182.

The moving speed of grinding member setting device 180 is configured to set the moving speed of the grinding member 110. The moving speed of grinding member setting device 180 controls a grinding member driving motor 190 configured to drive a driver 186. The grinding member driving motor 190 drives the grinding member 110 to rotate the grinding member 110 in accordance with an instruction of the moving speed of grinding member setting device 180, thereby moving the grinding member 110 at a moving speed set by the moving speed of the grinding member setting device 180.

The revolution speed of grinding member setting device 183 is configured to set the revolution speed of the grinding pad 120 of the grinding member 110. The revolution speed of grinding member setting device 183 controls the grinding member driving motor 190 and drives a driver 188. The grinding member driving motor 190 drives the grinding member 110 to rotate the grinding member 110 in accordance with an instruction from the grinding member setting device 183 for the revolution speed of grinding member 110, thereby rotating the grinding pad 120 at the revolution speed set by revolution speed of grinding member setting device 183.

The pressing force of grinding member setting device 184 is configured to set a pressing force of the grinding member 110 against the photoreceptor 2. The grinding member 110 is configured to press against the photoreceptor 2 by a known electrical-displacement mechanism (not shown). The pressing force of the grinding member setting device 184 controls the electrical-displacement mechanism and drives a driver 189.

The grinding condition setting device 104 sets the above-described grinding conditions of the photoreceptor grinding device 101 according to parameters by use of switch or program when the grinding condition setting device 104 includes a device or a personal computer, respectively. The grinding condition setting device 104 sets the grinding conditions of the photoreceptor grinding device 101 according to parameters as shown in the tables of FIGS. 12 and 14.

According to the embodiment of the present invention, the grinding conditions of the photoreceptor grinding device 101 are set by the grinding condition setting device 104 according to a measurement value, such as for example surface roughness or a layer thickness of the used photoreceptor 2, of the photoreceptor measuring device 103. As a result, the surface of the used photoreceptor 2 is adequately ground by the grinding member 110 according to the surface condition of the photoreceptor 2. Further, deterioration of photosensitive property of the photoreceptor 2 and leakage to the photoreceptor 2 due to excessive grinding of the photosensitive layer 2*a* of the photoreceptor 2 can be avoided. Thereby, an occurrence of failure image can be obviated, and a good quality image is obtained with the regenerated photoreceptor 2.

Further, according to the embodiment of the present invention, the surface of the used photoreceptor 2 is smoothed by grinding the surface with the grinding member 110. Therefore, a failure image such as an uneven toner image, a white spot, and a black line, and resonance noise produced between a leading edge of the cleaning blade and the surface of the photoreceptor due to high friction can be prevented.

Numerous additional modifications and variations of the present invention are possible in light of the above teachings. It is therefore to be understood that within the scope of the appended claims, the present invention may be practiced otherwise than as specifically described herein.

What is claimed is:

1. A photoreceptor regenerating apparatus for regenerating a photoreceptor for use in an image forming apparatus, comprising:

a grinding member configured to grind a surface of a used photoreceptor;

a photoreceptor measuring device configured to measure optically a surface condition of the used photoreceptor; and a grinding condition setting device configured to set grinding conditions of the grinding member according to an optically determined measurement value of the photoreceptor measuring device.

2. The photoreceptor regenerating apparatus according to claim 1, wherein the photoreceptor measuring device is configured to measure a surface roughness of the used photoreceptor, and wherein the grinding condition setting device is configured to set the grinding conditions of the grinding member according to the surface roughness of the used photoreceptor measured by the photoreceptor measuring device.

3. The photoreceptor regenerating apparatus according to claim 1, wherein the photoreceptor measuring device is configured to measure a layer thickness of the used photoreceptor, and wherein the grinding condition setting device is configured to set the grinding conditions of the grinding member according to the layer thickness of the used photoreceptor measured by the photoreceptor measuring device.

4. A regenerated photoreceptor for an image forming apparatus, comprising:

a substrate; and a photosensitive layer located overlying the substrate; wherein a surface of the photoreceptor is ground by the photoreceptor regenerating apparatus according to claim 1.

5. A regenerated photoreceptor for an image forming apparatus, comprising:

a substrate; and a photosensitive layer located overlying the substrate;

wherein a surface of the photoreceptor is ground by the photoreceptor regenerating apparatus according to claim 2.

6. A regenerated photoreceptor for an image forming apparatus, comprising:

a substrate; and a photosensitive layer located overlying the substrate;

wherein a surface of the photoreceptor is ground by the photoreceptor regenerating apparatus according to claim 3.

7. An image forming apparatus, comprising:

a photoreceptor configured to hold an image on a surface thereof;

a charging device configured to charge the surface of the photoreceptor;

a developing device configured to develop the image on the surface of the photoreceptor with developer to form a visual image;

a transfer device configured to transfer the visual image formed on the photoreceptor onto a recording medium; and a fixing device configured to fix the transferred visual image onto the recording medium, wherein the photoreceptor comprises the regenerated photoreceptor according to claim 4.

8. An image forming apparatus, comprising:

a photoreceptor configured to hold an image on a surface thereof;

a charging device configured to charge the surface of the photoreceptor;

a developing device configured to develop the image on the surface of the photoreceptor with developer to form a visual image;

a transfer device configured to transfer the visual image formed on the photoreceptor onto a recording medium; and a fixing device configured to fix the transferred visual image onto the recording medium, wherein the photoreceptor comprises the regenerated photoreceptor according to claim 5.

9. An image forming apparatus, comprising:

a photoreceptor configured to hold an image on a surface thereof;

a charging device configured to charge the surface of the photoreceptor;

a developing device configured to develop the image on the surface of the photoreceptor with developer to form a visual image;

a transfer device configured to transfer the visual image formed on the photoreceptor onto a recording medium; and a fixing device configured to fix the transferred visual image onto the recording medium, wherein the photoreceptor comprises the regenerated photoreceptor according to claim 6.

10. The image forming apparatus according to claim 7, wherein the photoreceptor and at least one of the charging device, the developing device, and the transfer device are integrally accommodated in an electrophotographic image forming process cartridge.

11. The image forming apparatus according to claim 8, wherein the photoreceptor and at least one of the charging device, the developing device, and the transfer device are integrally accommodated in an electrophotographic image forming process cartridge.

12. The image forming apparatus according to claim 9, wherein the photoreceptor and at least one of the charging device, the developing device, and the transfer device are integrally accommodated in an electrophotographic image forming process cartridge.

13. A method of regenerating a photoreceptor for use in an image forming apparatus, comprising:

measuring optically a surface condition of a used photoreceptor by a photoreceptor measuring device;

setting grinding conditions of a grinding member according to an optically determined measurement value of the photoreceptor measuring device; and grinding a surface of the used photoreceptor by the grinding member.

14. The method according to claim 13, wherein the step of measuring comprises measuring a surface roughness of the used photoreceptor, and wherein the step of setting comprises setting grinding conditions of the grinding member according to the surface roughness of the used photoreceptor.

15. The method according to claim 13, wherein the step of measuring comprises measuring a layer thickness of the used photoreceptor, and wherein the step of setting comprises setting grinding conditions of the grinding member according to the layer thickness of the used photoreceptor.

16. A regenerated photoreceptor for an image forming apparatus, comprising:

a substrate; and a photosensitive layer located overlying the substrate, wherein the photoreceptor is regenerated by the method of regenerating according to claim 13.

17. A regenerated photoreceptor for an image forming apparatus, comprising:

a substrate; and a photosensitive layer located overlying the substrate, wherein the photoreceptor is regenerated by the method of regenerating according to claim 14.

18. A regenerated photoreceptor for an image forming apparatus, comprising:

a substrate; and a photosensitive layer located overlying the substrate, wherein the photoreceptor is regenerated by the method of regenerating according to claim 15.

19. A photoreceptor regenerating apparatus for regenerating a photoreceptor for use in an image forming apparatus, comprising:

means for grinding a surface of a used photoreceptor;

means for measuring optically a surface condition of the used photoreceptor; and means for setting grinding conditions of the means for grinding according to an optically determined measurement value of the means for measuring.

* * * * *